United States Patent [19]

Matsushiro et al.

[11] Patent Number: 4,819,020

[45] Date of Patent: Apr. 4, 1989

[54] FIXING ROLLER AND ITS MANUFACTURING PROCESS

[75] Inventors: Moriyoshi Matsushiro, Toyohashi; Etsuaki Urano, Toyokawa, both of Japan

[73] Assignee: Minolta Camera Kabushika Kaisha, Osaka, Japan

[21] Appl. No.: 52,868

[22] Filed: May 22, 1987

[30] Foreign Application Priority Data

May 30, 1986 [JP] Japan ..... 61-126907

[51] Int. Cl.[4] ..... G03G 15/20

[52] U.S. Cl. ..... 355/3 FU; 355/14 FU; 219/216

[58] Field of Search ..... 355/14 FU, 3 FU; 219/216, 469, 470; 432/60, 228; 29/110; 427/372.2, 385.5

[56] References Cited

U.S. PATENT DOCUMENTS

| | | | |
|---|---|---|---|
| 3,776,760 | 12/1973 | Baker et al. | 117/72 |
| 3,940,518 | 2/1976 | Bowler, Jr. et al. | 427/379 |
| 4,179,601 | 12/1979 | Tarumi et al. | 219/216 |
| 4,199,626 | 4/1980 | Stryjewski | 355/3 FU X |
| 4,257,699 | 3/1981 | Lentz | 432/60 X |
| 4,434,355 | 2/1984 | Inagaki et al. | 219/469 X |
| 4,503,179 | 3/1985 | Yoshimura et al. | 524/262 |
| 4,550,243 | 10/1985 | Inagaki | 219/216 |
| 4,568,275 | 2/1986 | Inagaki | 219/216 |
| 4,596,920 | 6/1986 | Inagaki | 219/216 |

FOREIGN PATENT DOCUMENTS

| | | | |
|---|---|---|---|
| 0186314 | 7/1986 | European Pat. Off. | 355/3 FU |
| 54-109845 | 8/1979 | Japan | 355/3 FU |
| 56-133770 | 9/1981 | Japan | 355/3 FU |
| 58-2864 | 1/1983 | Japan . | |
| 58-5770 | 1/1983 | Japan . | |
| 58-214180 | 12/1983 | Japan | 355/3 FU |

*Primary Examiner*—A. C. Prescott
*Assistant Examiner*—Jane Lau
*Attorney, Agent, or Firm*—Burns, Doane, Swecker & Mathis

[57] ABSTRACT

A fixing roller of the present invention comprising at least an electrically conductive core member and a PFA dispersion layer formed from a polytetrafluoro ethylene perfluoro alkoxy ethylene co-polymer (PFA resin) with carbon black or like conductive material dispersed therein by means of a dispersing agent. A roller of this construction effectively prevents triboelectrically-induced offset caused by the electrostatic attraction of the toner by a surface charge on the outer peripheral surface of the roller. Since the release properties of said roller are superior, offset caused by thermal adhesion of the toner to the roller is also effectively prevented.

7 Claims, 4 Drawing Sheets

FIXING ROLLER AND ITS MANUFACTURING PROCESS

BACKGROUND OF THE INVENTION

1. Field of the Invention:

The present invention relates to a fixing roller and said fixing roller manufacturing process for a heat roller fixing device used in electrophotographic copying machines, facsimiles, printers and like machines using an electrophotographic process.

2. Description of the Prior Arts:

Conventional electrophotographic copying machine, heat roller fixing devices are known, like the device disclosed in Tokkai Sho 59-111177.

Conventional fixing devices comprise a heating roller incorporating a heater which have a separation layer on the electrically conductive core member. A pressure roller makes pressure contact with said heating roller, and an insulating roller on an electrically conductive core member. In such devices, copy paper, having a charged toner image thereon, pass between both rollers with the toner-bearing surface facing the heating roller, whereby the toner image is fixed onto the copy paper.

With this type of heat roller fixing device having a heat-fixing roller, the heated roller surface has sufficiently good release properties to prevent thermal adhesion of the toner without necessitating the application of silicone oil or a like offset preventing agent, or with use of only a very small amount of such agent. Thus, the copy paper feels pleasant to the touch.

However, the separation surface layer of the heated roller can be triboelectrically charged by the insulating surface layer of the pressure roller or by contact with the copy paper and as such is liable to electrostatically attract the toner and permit offset. This type of triboelectrically-induced offset cannot be prevented by the application of a offset preventing agent.

While it is known, as disclosed in Tokkai Sho 57-150869, that electrical resistance is reduced when a large amount of carbon black or other conductive substance is incorporated in the primer layer to prevent such charging if a large amount of carbon black, or like substance, is incorporated in the primer layer, the adhesive property of said primer layer is reduced and its essential function is lost. A further limitation is the occurrence of cracking in the thin primer layer caused by a large content of carbon black or like substance.

Another limitation of conventional devices employing resin powder coatings which incorporate large amounts of conductive substances applied over the primer, is the impossibility of effectively preventing triboelectrically-induced offset.

SUMMARY OF THE INVENTION

The primary object of the present invention is to provide, without the aforesaid limitations, a fixing roller for a heat roller fixing device, and a manufacturing method, for said fixing roller wherein triboelectrically-induced offset, caused via electrostatic attraction of the charged toner to the outer peripheral surface of the heating roller, can be prevented.

The object of the present invention is accomplished by providing a copying machine with a fixing roller comprising at least an electrically conductive core member and a polytetrafluoro ethylene perfluoro alkoxy ethylene co-polymer resin (PFA resin) wherein a PFA dispersion layer is obtained by dispersing the conductive material in a dispersing agent.

DETAILED DESCRIPTION OF THE INVENTION

Figure 1:
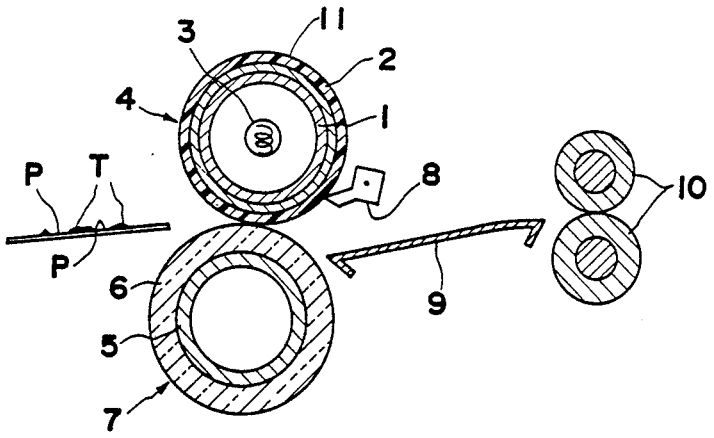
FIG. 1 is a side elevation view showing the heat roller fixing device incorporating a fixing roller of the present invention.

FIG. 1 shows a sectional view of a heat roller fixing device having a fixing roller according to the present invention, said fixing device comprising a heating roller 4 incorporating a heater 3 and having a grounded conductive core member 1 with a primer layer 2, and a resin separation layer 11 successively layered thereon. A pressure roller 7 makes pressing contact with the heating roller 4 and is comprised of an insulating layer 6 on a conductive core member 5. Copy paper P having a charged toner image T formed thereon is passed between both rollers, 4 and 7, with the toner-bearing surface facing the heating roller 4, whereby toner image T is fixed onto copy paper P. Copy paper P bearing the toner image T is separated from the roller via separating pawl 8 and proceeds to guide plate 9 from which it is discharged via paper discharge roller 10.

Examples of materials for the electrically conductive core member, used with the heating roller and pressure roller, are aluminum, aluminum alloy, iron alloys such as stainless steel, and other metals.

The primer layer 2 of the heating roller is formed from a solution-type primer composed chiefly of fluorine resin, which is commercially available as an adhesive priming agent for the aforesaid iron alloys, aluminum alloys and like metals. Examples of useful primers are COOKWEAR A PRIMER WHITE 459-882 (proprietary name, product of Du Pont Co., Ltd., Japan) and MP902YL (proprietary name, product of Mitsui Phlorochemical Co., Japan), etc. Carbon black or metallic powder may be used as the electrically conductive material incorporated into this primer layer; the carbon black used may be furnace black, channel black or thermal black. Examples of such products commercially available are KETCHEN BLACK EC (proprietary name, product of Lion Yushi Co., Ltd., Japan), SPECIAL BLACK 4 (proprietary name, product of Degussa Co., Ltd., Japan), CARBON BLACK MA-100 and MA-8 (proprietary names, products of Mitsubishi Chemical Industries, Ltd., Japan), ACETYLENE BLACK (proprietary name, product of Denki Kagaku Kogyo Kabushiki Kaisha, Japan), etc.

The carbon black is incorporated in the primer, preferably at a rate of 6% or less by volume. Incorporation of an excessive amount of carbon black is undesirable as the strength of the primer layer is thus reduced.

The resin separation layer 11 is formed from a mixture of a fluorine resin with superior release properties and heat tolerance such as PFA resin, and electrically conductive particles, such as carbon black powder.

In more detail, the resin separation layer 11 comprises a PFA dispersion layer incorporating electrically conductive material, formed by dissolving said PFA resin in a dispersant and then incorporating a conductive material in the PFA dispersion layer with a resin powder separation layer laminated thereon. In the present embodiment, the PFA dispersion layer is formed from, for example, X500 (proprietary name, produced by Mitsui-Du Pont Phlorochemical Co.) comprising about 35% PFA resin particles of approximately 0.5 μm diameter.

The electrically conductive material incorporated in the PFA dispersion layer is of the same type as that incorporated in the aforesaid primer layer, and in the case of carbon black the preferred amount is 9% or less by volume. Because more electrically conductive material can be incorporated in the PFA dispersion layer of the present invention than in conventional PFA powder layers, the electrical resistance of the outer peripheral surface of the roller can be reduced to $10^{6-10}\Omega$. This prevents triboelectrically-induced offset via electrostatic attraction of the toner.

Offset caused by thermal adhesion of the toner can be effectively prevented by the PFA dispersion layer due to the release properties and strength of said layer, which are superior to known conventional polytetrafluoro ethylene (PTFE resin) dispersion.

Additionally, the PFA dispersion layer obtained in the present invention can be applied in uniform coatings without irregularities, even in the case of small diameter rollers. Such uniformity is difficult to achieve using conventional methods.

The insulating layer of the pressure roller is formed from an insulating material such as natural rubber or synthetic rubber, or other conventional material having rubber-like elasticity.

The heating roller in the present embodiment may be obtained, for example, by the following process.

Figure 2A:
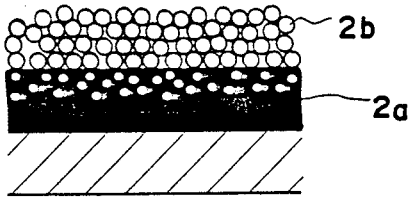
FIG. 2 is an enlarged view showing the surface processing sequence for the fixing roller of the present invention.
Figure 2:
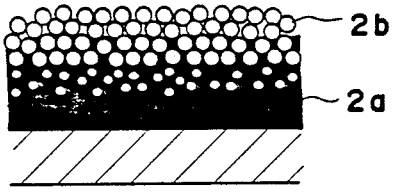
Figure 2:
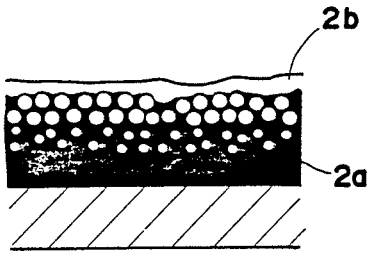

Using a piece of aluminum 25 mm in diameter, 230 mm in length and having a wall thickness of 1.3 mm as the electrically conductive member of the heating roller, was preheated for one hour at 70° C. After coating the core member with a primer using an air spray gun at 2–3 kg/cm$^2$ pressure and drying said primer for 10 min at 60° C., the adhesive strength bonding the primer layer to the core member increases. Next, the PFA dispersion layer 2*a* incorporating carbon black was applied in the same manner using an air spray gun at 2–3 kg/cm$^2$ pressure. After air drying for 30 min a second PFA dispersion layer was sprayed onto the core member and, without interruption, a coating of PFA powder 2*b* was applied with an electrostatic spray device as shown in FIG. 2(*a*). The overall coating was then dried at 100° C. for 20 min. By means of the above drying process, and the hereinafter described baking process, pinhole generation induced by uneven evaporation of the moisture in the dispersion layer is prevented. Also, at this time the dispersion layer penetrates to the PFA powder (2*b*) as shown in FIG. 2(*b*).

Next, the core member was baked at 380°–400° C. for one hour, whereby the heating roller, formed from a PFA dispersion layer with a PFA powder overlaid thereon, was obtained, as shown in FIG. 2(*c*). The heating roller is subsequently ground in a final step to expose the PFA dispersion layer at portions of the outermost surface of the roller, e.g., the carbon black incorporated in the PFA dispersion layer is exposed at portions of the outermost peripheral surface of the roller.

By means of this construction the surface charge on the outer peripheral surface of fthe roller is grounded through the electrically conductive core member 1, said surface charge being transmitted to the conductive core member via the carbon black incorporated in the PFA dispersion layer, and the carbon black incorporated in the primer layer. Thus, triboelectrically-induced offset due to the electrostatic attraction of the toner can be effectively prevented.

Thermal adhesion of the toner can also be prevented due to the superior release properties and strength of the PFA dispersion layer of the present invention.

In the present embodiment, the fixing roller related to the invention was used in a heating roller, but it is also applicable for use in a pressure roller.

Although the present embodiment provides a PFA dispersion layer with a PFA powder layer applied thereon, the PFA powder layer may be omitted. However, provision of a PFA powder layer enhances the release properties of the roller and its effective in preventing offset.

When a PFA powder layer is provided, the surface of said layer is ground to expose portions of the underlying PFA dispersion layer, e.g., portions of the carbon black incorporated in the PFA dispersion layer are exposed through the surface of the PFA powder layer. Thus, triboelectrically-induced offset due to electrostatic attraction of the toner can be prevented.

When an excessive amount of the PFA powder layer is ground, the release properties are diminished, however, because the present invention provides a PFA powder layer applied on a PFA dispersion layer, only a small amount need be ground.

Although the present embodiment provides a core member with a primer layer applied thereon, this primer layer may be omitted. However, provision of a primer layer on the core member is preferred as it enhances the adhesion of the PFA dispersion layer to the core member.

EXAMPLE 1

A first layer (primer layer); and second layer (PFA dispersion layer) composed of the hereinafter listed material compositions were successively laminated on an electrically conductive core member, whereby a heating roller was obtained.

| | | |
|---|---|---|
| 1st layer | Primer: Carbon black | 3% |
| | Polyamide<br>PFA resin | 97% |
| 2nd layer | PFA Dispersion: Carbon black | 9% |
| | PFA resin | 91% |

A roller was fabricated according to the aforementioned processes and material compositions with film thicknesses (coating weights) as shown in Table 1, said roller was then tested for the occurrence of offset and the amount of triboelectric charging of the roller.

TABLE 1

| | | | | |
|---|---|---|---|---|
| 1st layer | 0.4 g | | 1.0 g | |
| 2nd layer | 0.4 g | 1.2 g | 0.4 g | 1.2 g |

The reslts are shown in Table 2.

TABLE 2

| 1st layer | 2nd layer | Heating roller charging potential | Offset | Coating resistance |
|---|---|---|---|---|
| 0.4 g | 0.4 g | −10~− 19 V | 0~Δ | $10^6\ \Omega$ |

TABLE 2-continued

| 1st layer | 2nd layer | Heating roller charging potential | Offset | Coating resistance |
|---|---|---|---|---|
| | 1.2 g | −8∼− 21 V | 0∼Δ | ↑ |
| 1.0 g | 0.4 g | −11∼− 16 V | 0∼Δ | ↑ |
| | 1.2 g | −13∼− 18 V | 0∼Δ | ↑ |

The results shown in Table 2 were evaluated as follows: The absence of offset is indicated by 0, offset with an ambiguous pattern is indicated by Δ, offset with a definite pattern is indicated by X, and offset with a clear pattern and character is indicated by XX.

An offset chart made by Kodak Co., Ltd. was used as a test pattern.

It is understood from the results shown in Table 2 that a heating roller manufactured by the aforesaid process has minimal triboelectric charging and surface resistance.

EXAMPLE 2

A heating roller was obtained in the manner described in Example 1 except that on the second layer was applied a third layer having composition listed below.

| | | |
|---|---|---|
| 3rd layer | PFA powder: PFA resin | 100% |

A roller was fabricated according to the aforementioned process with film thicknesses (coating weights) as shown in Table 3, the resulting rollers were then subjected to the same tests as in Example 1, the results of which are listed in Tables 4 to 6 below.

TABLE 3

| 1st layer | 0.4 g | | | 0.7 g | | | 1.0 g | | |
|---|---|---|---|---|---|---|---|---|---|
| 2nd layer | 10 g | | 1.5 g | 1.0 g | | 1.5 g | 1.0 g | | 1.5 g |
| 3rd layer | 0.4 g | 0.8 g | 1.2 g | 0.4 g | 0.8 g | 1.2 g | 0.4 g | 0.8 g | 1.2 g |

TABLE 4

| 1st layer | 2nd layer | 3rd layer | Heating roller charging potential | Offset | Coating resistance |
|---|---|---|---|---|---|
| 0.4 g | 1.0 g | 0.4 g | −10∼−15 V | O | $10^6\ \Omega$ |
| | | 0.8 g | −50∼−95 V | X | $10^{9\sim11}\ \Omega$ |
| | | 1.2 g | −80∼−150 V | X | $10^{14}\ \Omega<$ |
| | 1.5 g | 0.4 g | −11∼−13 V | O | $10^6\ \Omega$ |
| | | 0.8 g | −63∼−90 V | X | $10^8\ \Omega$ |
| | | 1.2 g | −100∼−175 V | X | $10^{14}\ \Omega<$ |

TABLE 5

| 1st layer | 2nd layer | 3rd layer | Heating roller charging potential | Offset | Coating resistance |
|---|---|---|---|---|---|
| 0.7 g | 1.0 g | 0.4 g | −8∼−16 V | O | $10^6\ \Omega$ |
| | | 0.8 g | −54∼−89 V | X | $10^8\ \Omega$ |
| | | 1.2 g | −90∼−175 V | X | $10^{14}\ \Omega<$ |
| | 1.5 g | 0.4 g | −13∼−18 V | O | $10^6\ \Omega$ |
| | | 0.8 g | −50∼−90 V | X | $10^9\ \Omega$ |
| | | 1.2 g | −85∼−150 V | X | $10^{14}\ \Omega<$ |

TABLE 6

| 1st layer | 2nd layer | 3rd layer | Heating roller charging potential | Offset | Coating resistance |
|---|---|---|---|---|---|
| 1.0 g | 1.0 g | 0.4 g | −11∼−20 V | O | $10^6\ \Omega$ |
| | | 0.8 g | −48∼−70 V | X | $10^7\ \Omega$ |
| | | 1.2 g | −100∼−150 V | X | $10^{14}\ \Omega<$ |

TABLE 6-continued

| 1st layer | 2nd layer | 3rd layer | Heating roller charging potential | Offset | Coating resistance |
|---|---|---|---|---|---|
| | 1.5 g | 0.4 g | −18∼−20 V | O | $10^6\ \Omega$ |
| | | 0.8 g | −48∼−75 V | X | $10^8\ \Omega$ |
| | | 1.2 g | −90∼−140 V | X | $10^{14}\ \Omega<$ |

EXAMPLE 3

A roller was fabricated with the coating material layer composition as indicated hereinafter and tested in the same manner as described in Example 1, the results of which are shown in Table 7.

TABLE 7

| 1st layer | 2nd layer | 3rd layer | Heating roller charging potential | Offset | Coating resistance |
|---|---|---|---|---|---|
| 0.4 g | 1.0 g | 0.4 g | −8∼−15 V | O | $10^6\ \Omega$ |
| | | 0.8 g | −46∼−50 V | X | $10^8\ \Omega$ |
| | | 1.2 g | −80∼−120 V | X | $10^{14}\ \Omega<$ |
| | 1.5 g | 0.4 g | −11∼−18 V | O | $10^6\ \Omega$ |
| | | 0.8 g | −53∼−75 V | X | $10^8\ \Omega$ |
| | | 1.2 g | −95∼−145 V | X | $10^{14}\ \Omega<$ |

| | | |
|---|---|---|
| 1st layer | Primer: Carbon black | 6% |
| | Polyamide<br>PFA resin | } 94% |
| 2nd layer | PFA dispersion: Black | 9% |
| | PFA resin | 91% |
| 3rd layer | PFA powder: PFA resin | 100% |

The evaluation standards regarding offset are identical with those of Example 1. Since, from the results of Examples 2 and 3, a closer relationship was inferred between the film thickness of the third layer and the occurrence of offset caused by the heating roller, than existed with the volumes of carbon black in the first and second layers, the rollers exhibiting poor offset qualities in Examples 2 and 3 were thinned by grinding their surfaces in 0.2 g increments and then re-tested, the results of which are shown in the graphs in FIGS. 3, 4 and 5. The film thickness compositions in the graphs is as indicated below.

Figure 3:
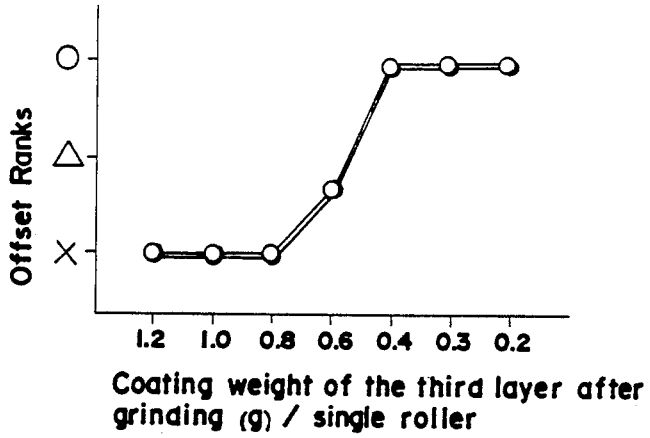
FIGS. 3 to 5 are graphs showing the offset ranks obtained via the prescribed grinding of the roller and a graph showing the weight relationships of a third layer of the roller in an embodiment of the present invention.

FIG. 3 . . . Relates to the roller in Example 2.

| | 1st layer | 2nd layer | 3rd layer |
|---|---|---|---|
| O—O: | 0.4 g | 1.0 g | 1.2 g |
| •—•: | 0.4 g | 1.5 g | 1.2 g |

Figure 4:
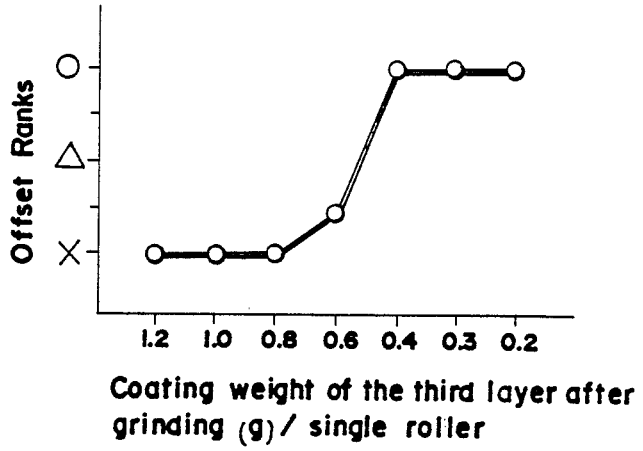

FIG. 4 . . . Relates to the identical roller in Example 2.

| | 1st layer | 2nd layer | 3rd layer |
|---|---|---|---|
| O—O: | 1.0 g | 1.0 g | 1.2 g |
| •—•: | 1.0 g | 1.5 g | 1.2 g |

Figure 5:
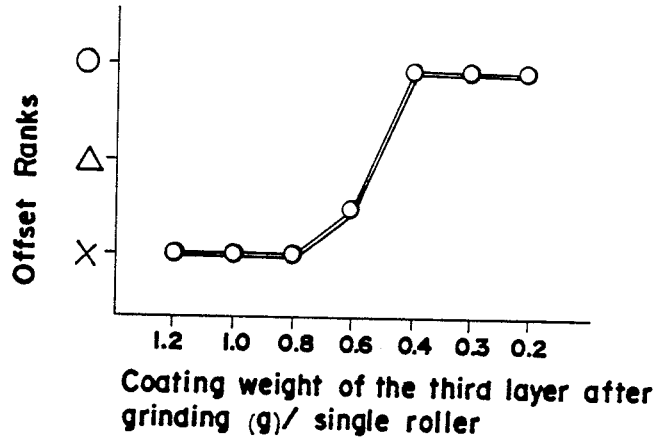

FIG. 5 . . . Relates to the roller in Example 3.

| | 1st layer | 2nd layer | 3rd layer |
|---|---|---|---|
| O—O: | 0.4 g | 1.0 g | 1.2 g |
| •—•: | 0.4 g | 1.5 g | 1.2 g |

It is understood from the above results that when the coating weight of the third layer is 0.4 g or less, offset does not occur.

EXAMPLE 4

A roller was fabricated using identical coating weight compositions as in Example 1 but with a reduced percentage of carbon black incorporated in the second layer than was used in the aforementioned Examples 1 through 3, the roller then was tested and the results obtained are shown in Table 8.

The material composition of each layer is listed below.

| | | |
|---|---|---|
| 1st layer | Primer: Carbon black | 3% |
| | Polyamide<br>PFA resin | 97% |
| 2nd layer | PFA dispersion: | |
| | Carbon black | 3% |
| | PFA resin | 97% |
| 3rd layer | PFA powder: PFA resin | 100% |

The results shown in Table 8 verify that offset does not occur when the third layer coating weight is 0.4 g or less.

TABLE 8

| 1st layer | 2nd layer | 3rd layer | Heating roller charging potential | Offset | Coating resistance |
|---|---|---|---|---|---|
| 0.4 g | 1.0 g | 0.4 g | −12∼−27 V | O | $10^6$ Ω |
| | | 0.8 g | −50∼−75 V | X | $10^{10}$ Ω |
| | | 1.2 g | −100∼−115 V | X | $10^{14}$ Ω< |
| | 1.5 g | 0.4 g | −14∼−24 V | O | $10^6$ Ω |
| | | 0.8 g | −80∼−90 V | X | $10^{11}$ Ω |
| | | 1.2 g | −90∼−120 V | X | $10^{14}$ Ω< |

COMPARATIVE EXAMPLE

Using the material compositions described hereinafter, a conventional heating roller was fabricated and was then tested with the results as shown in Tables 9 and 10.

| Material Composition | | |
|---|---|---|
| 1st layer | Primer: Carbon black | 6% |
| | Polyamide<br>PFA resin | 94% |
| 2nd layer | PFA powder: PFA resin | 100% |

As can be seen from the results shown in Tables 9 and 10, when the PFA dispersion layer was not provided and the postgrinding coating weight of the third layer was 0.2 to 0.1 g or less, offset was not completely eliminated.

TABLE 9

| 1st layer | 2nd layer | Heating roller charging potential | Offset | Coating resistance |
|---|---|---|---|---|
| 0.4 g | 0.4 g | −20∼−40 V | Δ∼X | $10^{6-7}$ Ω |
| | 0.8 g | −90∼−105 V | X | $10^{10}$ Ω |
| | 1.2 g | −115∼−145 V | X | $10^{14}$ Ω< |

TABLE 10

| 1st layer | 2nd layer | Heating roller charging potential | Offset | Coating resistance |
|---|---|---|---|---|
| 1.0 g | 0.4 g | −22∼−48 V | Δ∼X | $10^7$ Ω |
| | 0.8 g | −60∼−95 V | X | $10^{11}$ Ω |
| | 1.2 g | −90∼−130 V | X | $10^{14}$ Ω< |

What is claimed is:

1. A fixing roller for use in a copying apparatus comprising:
   - an electrically conductive core member;
   - a primer layer formed on said electrically conductive core member and comprising a primer having incorporated therein an electrically conductive material;
   - a dispersion layer formed on said primer layer by dispersing a polytetrafluoroethylene perfluoro alkoxy ethylene co-polymer (PFA resin) with a conductive material in a dispersing agent; and
   - a powdery resin layer having release properties and formed on said dispersion layer with said conductive material exposed at the outer surface of said powdery resin layer.

2. A fixing roller as claimed in claim 1, wherein said conductive material incorporated in said dispersion layer is carbon black.

3. A fixing roller as claimed in claim 2, wherein said carbon black is preferably incorporated in said dispersion layer in an amount of less than 9%.

4. A process for preparing a fixing roller which comprises an electrically conductive core member and a resin layer having release properties and is used in a copying apparatus, said process comprising:
   - a first step of heating said core member to a predetermined temperature for a predetermined time;
   - a second step of coating a primer layer on said electrically conductive core member, said primer layer comprising a primer having therein an electrically conductive material;
   - a third step of coating a dispersion layer on said primer layer, said dispersion layer being formed by dispersing a polytetrafluoro ethylene perfluoro alkoxy ethylene co-polymer (PFA resin) with a conductive material in a dispersing agent;
   - a fourth step of coating a powdery resin layer having release properties on said dispersion layer;
   - a fifth step of drying and sintering said powdery resin layer; and
   - a sixth step of grinding said powdery resin layer after said fifth step so as to expose said conductive material at the outer surface of said powdery resin layer.

5. A process as claimed in claim 4, wherein said conductive material incorporated in said dispersion layer is carbon black.

6. A fixing roller for use in a copying apparatus comprising:
   - an electrically conductive core member;
   - a primer layer formed on said electrically conductive core member and comprising a primer having incorporated therein an electrically conductive material; and
   - a resin separation layer formed on said primer layer and comprising a conductive material, said resin layer being comprised of a dispersion layer formed by dispersing a polytetrafluoroethylene perfluoro alkoxy ethylene copolymer (PFA resin) and a powdery resin layer having release properties and formed on said dispersion layer, said conductive material content in the powdery resin layer being less than that of the dispersion layer.

7. A fixing roller as claimed in claim 6, wherein said conductive material incorporated in said resin separation layer is carbon black.

* * * * *